US005718514A

United States Patent [19]

Steele et al.

[11] Patent Number: 5,718,514

[45] Date of Patent: Feb. 17, 1998

[54] MULTIWALL BAG

[75] Inventors: Raymond George Steele, Auckland; Stephen John Grace, Parua; John Frederick Robinson; Andreas Karl Haussrer, both of Auckland; Eric John Brown, Papakura; Michael John Kane, Auckland; Allan Paul MacFarlane, Auckland; Ian Murray Allerby, Auckland, all of New Zealand

[73] Assignee: Stone Container Corporation, Chicago, Ill.

[21] Appl. No.: 687,829

[22] Filed: Jul. 26, 1996

Related U.S. Application Data

[63] Continuation of Ser. No. 192,710, Feb. 7, 1994, abandoned.

[51] Int. Cl.[6] ..... B65D 33/18

[52] U.S. Cl. ..... 383/211; 383/67; 383/41; 383/99; 383/111

[58] Field of Search ..... 383/210, 211, 383/98, 99, 111, 115, 41, 67

[56] References Cited

U.S. PATENT DOCUMENTS

| | | | |
|---|---|---|---|
| 1,833,675 | 11/1931 | Geimer | 383/211 |
| 2,161,071 | 6/1939 | McGrath et al. | 99/171 |
| 2,255,975 | 9/1941 | Hultkrans | 93/6 |
| 2,396,565 | 3/1946 | Gardner | 229/58 |
| 2,582,286 | 1/1952 | Schenck | 229/62 |
| 2,833,094 | 5/1958 | Moore | 53/14 |
| 2,948,457 | 8/1960 | Thiele | 383/211 |
| 3,306,522 | 2/1967 | Honsel | 229/55 |
| 3,485,438 | 12/1969 | McCall et al. | 229/58 |
| 3,599,539 | 8/1971 | Coverstone et al. | 93/35 SB |
| 3,807,626 | 4/1974 | Goodrich | 383/111 |
| 3,929,275 | 12/1975 | Bolling et al. | 383/111 |
| 3,958,749 | 5/1976 | Goodrich | 383/111 |
| 4,260,061 | 4/1981 | Jacobs | 383/211 |

FOREIGN PATENT DOCUMENTS

| | | | |
|---|---|---|---|
| 51656 | 9/1970 | Australia . | |
| 126602 | 12/1994 | Australia . | |
| 0283279 | 9/1988 | European Pat. Off. | B65D 33/18 |
| 23252 | 7/1930 | New Zealand | 81/27 |

OTHER PUBLICATIONS

New Zealand Patent Office Jounal No. 1372 Issued on 27 Sep. 1993 vol. 82 Issue No. 8 p. 1199.

International Organization for STandardization, ISO 6590/1; "Packaging–Sacks–Vocabulary and Types–Part 1: Paper Sacks" pp. 6, 8.

*Primary Examiner*—Stephen P. Garbe

*Attorney, Agent, or Firm*—Dick and Harris

[57] ABSTRACT

A container apparatus and method of manufacture for same, in which the container includes an inner tube formed of plastic material, and an outer tube of one or more plies of material. The container is generally configured to lie flat, when in its unfilled condition. The container has a flat first end formed from flap members configured from one or more plies of the outer tube. The container is advantageously configured to enable opening of the first end of the outer tube to provide access to the inner tube.

10 Claims, 8 Drawing Sheets

MULTIWALL BAG

This is a file wrapper continuing application Ser. No. 08/192,710, filed Feb. 7, 1994, now hereby abandoned.

BACKGROUND OF THE INVENTION

The present invention relates to improvements in and or relating to bags having multiple plies, apparatus for manufacturing same, methods of manufacturing same, uses thereof and related means and methods.

Many forms of bag containers formed of multiple plies are known. Many of these are in the form of a multiwall bag sometimes with a plastics material inner liner. The present invention is directed to improvements in such a container and is adapted to provide at least some customer choice in relation to containers of that type.

A prior art form of construction is that as hereinafter described and the present invention is preferably directed to a form of such container where no base patch is required that is separate from the plies of the outer tube of such a container and/or which, upon opening, will minimize loose pieces of material.

It is, therefore, an object of the present invention to go at least some way to meet the above-mentioned objects or at least provide the public with a useful choice.

SUMMARY OF THE INVENTION

The invention consists in a lie flat container (e.g. a bag) having a tube (extruded or fabricated) of a sealable plastics material (hereafter "the inner tube") disposed within an exterior tube (hereafter "the outer tube"), each tube having been formed of at least one web of a planar material (preferably paper or multiple plies of paper). The just-mentioned end (hereafter the "first" or "factory" end) of each of the inner tube and outer tube is separately closed while the other end of each of the inner tube and outer tube is open (hereafter the "second" or "customer" end) to allow the filling of the inner tube prior to the sealing thereof, and wherein, in its lie flat, unfilled condition, each tube simply lies as a simple fold connected front and back panel, except at the factory end, where the outer tube at least has been conformed from factory end regions of the front and back panels of the outer tube to a substantially planar base region disposed in a lie flat condition over one or other of the front or back panels of the outer tube, said outer tube at said factory end being held closed at least primarily by overlying flaps from the factory end extremity of each of the front and back panels, the flaps while adhered one to the other being capable of being peel separated so that, in use, if desired, the filled and sealed inner tube, if not permanently attached to the outer tube at the customer end, can be removed from the factory end after the peel separation of the flaps to allow opening of the outer tube at the factory end.

In a preferred embodiment of the invention, the container is in the form of a bag, with the exterior tube being formed from paper, preferably from multiple plies of paper. Preferably, the inner tube at the customer end is adhered at least in a tack manner to the outer tube at the customer end to facilitate filling of the inner tube.

Preferably one or both of the flaps is of a multiple ply construction.

Preferably the overlying flap of the base at the factory end is of a multiple ply and part of one ply of the overlying flap is adhered to the factory end of the inner tube while the factory end of the inner tube is adhesively associated with at least one ply of the underlying flap.

Preferably the container operates such that, when lying substantially horizontally, the overlying flap of the base can be lifted by a person using one or two hands, the container then being movable to a condition where the base is directed downwardly and the weight of the contents in the inner tube will allow the dropping free thereof from the outer tube or the lifting free of the outer tube from the inner tube or a combination of both by breaking associations and/or adhesive associations without releasing any substantial loose pieces of material from the outer tube and/or inner tube.

The container is preferably substantially rectangular in form.

Preferably the outer tube is substantially as hereinafter described with reference to any one or more of the accompanying drawings.

In another aspect the invention is a container substantially as hereinafter described with reference to any one or more of the accompanying drawings other than FIGS. 3A, 3B and 3C.

In still a further aspect the invention consists in a method of forming a lie flat container having a tube of a sealable plastics material (hereafter "the inner tube") disposed within an exterior tube (hereafter "the outer tube"), each tube having been formed of at least one web of a planar material, the same end (hereafter "the factory end") of each of the inner tube and outer tube being separately closed while the other end of each of the inner tube and outer tube is open (hereafter "the customer end") to allow the filling of the inner tube prior to the sealing thereof, and wherein, in its lie flat, untilled condition, each tube simply lies as a simple fold connected front and back panel except at the factory end where the outer tube at least has been shaped from factory end regions of the front and back panels of the outer tube to form a substantially planar base region disposed in a lie flat condition over one or other of the front or back panels of the outer tube. The outer tube at said factory end is held closed at least primarily by overlying flaps from the factory end extremity of each of the front and back panels, the flaps while adhered one to the other being capable of being peel separated so that, in use, if desired, the filled and sealed inner tube, if not permanently attached to the outer tube at the customer end, can be removed from the factory end after the peel separation of the flaps to allow opening of the outer tube at the factory end. The method comprises the steps of:

1. advancing a feed of a inner tube and a outer tube, the inner tube being within the outer tube,
2. heat sealing the factory end of the advanced inner tube,
3. spreading the factory end of the advanced outer tube out together with part of the sealed factory end of the inner tube to define a lie flat base from which extends in opposite directions (parallel to the locus of advancement) said flaps of the base and
4. thereafter adhesively inter-engaging said flaps, the completed lie flat container structure being a discrete item after, if necessary, a cutting of the feeds of material at the customer end.

Preferably said method involves the use of one or several plies of a paper from which the outer tube is to be formed, a tubular plastics material from which the inner tube is formed, forming the outer tube about the inner tubular material, making appropriate perforations and/or cuts as well as a heat seal to close the inner tube of the plastics material and sequentially adhesive closing the factory end of the outer tube in the manner determinable by reference to any of the accompanying drawings other than FIGS. 3A, 3B and 3C.

In still a further aspect the invention consists in a method of forming a container substantially as hereinafter described when performed substantially as hereinbefore described with reference to any one or more of the accompanying drawings.

In a further aspect the invention is any container of the present invention when the inner tube has been filled with a material and the inner tube is sealed at the customer end and the outer tube is also sealed at the customer end.

The material with which the inner tube is filled is preferably a powder or liquid.

In a further aspect the invention consists in a method of handling a material capable of being poured selected from a powder, liquid or discrete items, such as granules, which involves the operative use of a lie flat container of the present invention and/or one produced by a method of the present invention and/or the opening and removal of a filled inner tube from the outer tube thereof that has been sealed at the customer end.

In a further aspect the invention is a method of handling a material when performed substantially as hereinafter described with reference to the accompanying drawings.

The invention consists in the foregoing and also envisages constructions of which the following gives examples.

BRIEF DESCRIPTION OF THE DRAWINGS

FIG. 1A shows a bag, according to the present invention, substantially lying flat presenting the base region for opening;

FIG. 1B shows the bag according to FIG. 1A, in which the outermost outer flap of the base region is being pulled so as to separate the adhesively fixed overflap from the other outer flap;

FIG. 1C shows the full opening of the outermost outer flap;

FIG. 1D shows the bag immediately prior to lifting of the bag upright;

FIG. 1E shows the bag with the end flaps re-opened, when lifted upright with the inner tube full of a powder or liquid material falling free of the outer tube notwithstanding any slight adhesive or other tacking of the inner tube to the factory end of the outer tube;

FIG. 2A shows the "factory" end of the bag, with the bag in a flattened configuration, with both outer flaps lying flat in their unarticulated positions;

FIG. 2B shows the bag of FIG. 2A, with the minor or inner outer flap folded over;

FIG. 2C shows the bag of FIGS. 2A and 2B, with the outermost or major outer flap folded over;

FIG. 3A shows the "factory" end of a prior art bag, with the bag in a flattened configuration, with both outer flaps lying flat in their unarticulated positions;

FIG. 3B shows the bag of FIG. 3A, with the minor or inner outer flap folded over;

FIG. 3C shows the bag of FIGS. 3A and 3B, with the outermost or major outer flap folded over;

FIGS. 2A-1 to 2C-1 show a slightly different embodiment to the form as shown in FIGS. 2A to 2C, this different embodiment providing for a greater glued flap overlap;

FIG. 2A-1 shows the "factory" end of the bag, with the bag in a flattened configuration, with both outer flaps lying flat in their unarticulated positions;

FIG. 2B-1 shows the bag of FIG. 2A-1, with the minor or inner outer flap folded over;

FIG. 2C-1 shows the bag of FIGS. 2A-1 and 2B-1, with the outermost or major outer flap folded over.

DETAILED DESCRIPTION OF THE DRAWINGS

Figure 1A:
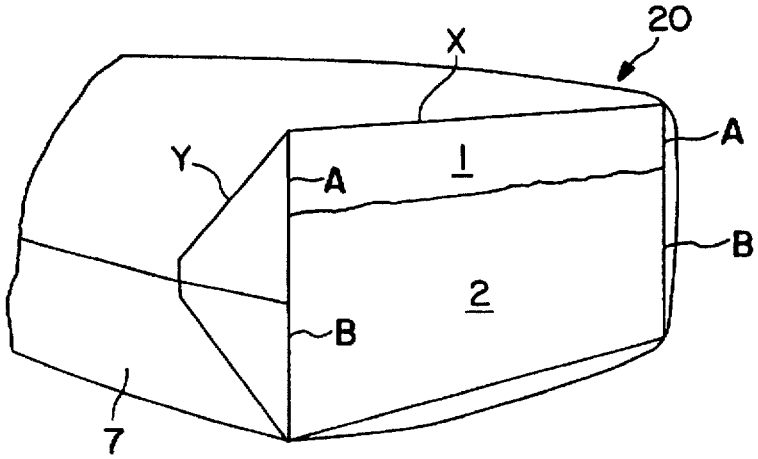
FIGS. 1A through 1E show the factory end of a preferred bag-like container in accordance with the present invention.
Figure 1B:
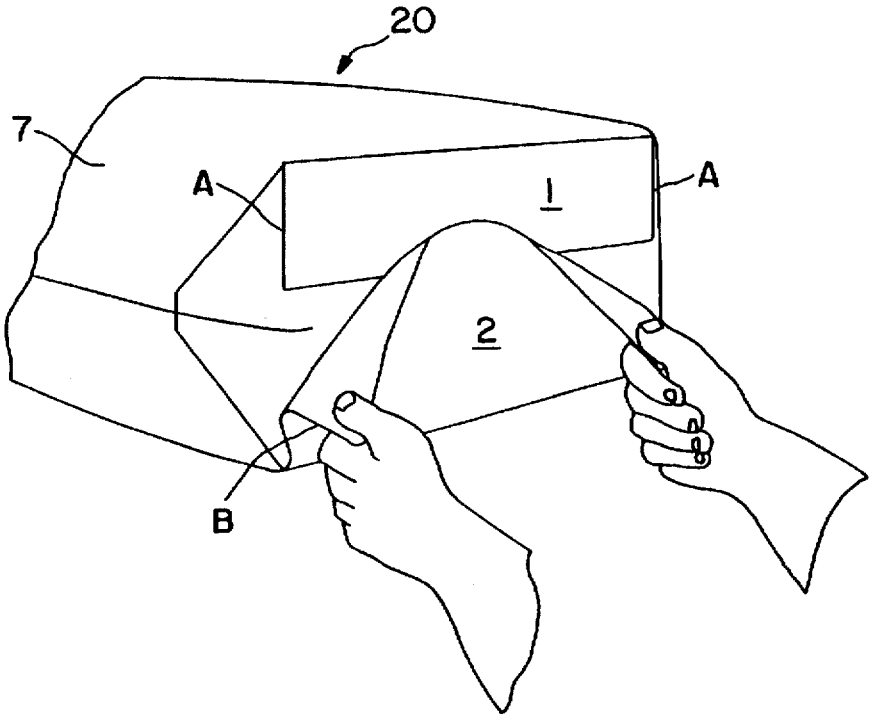
Figure 1C:
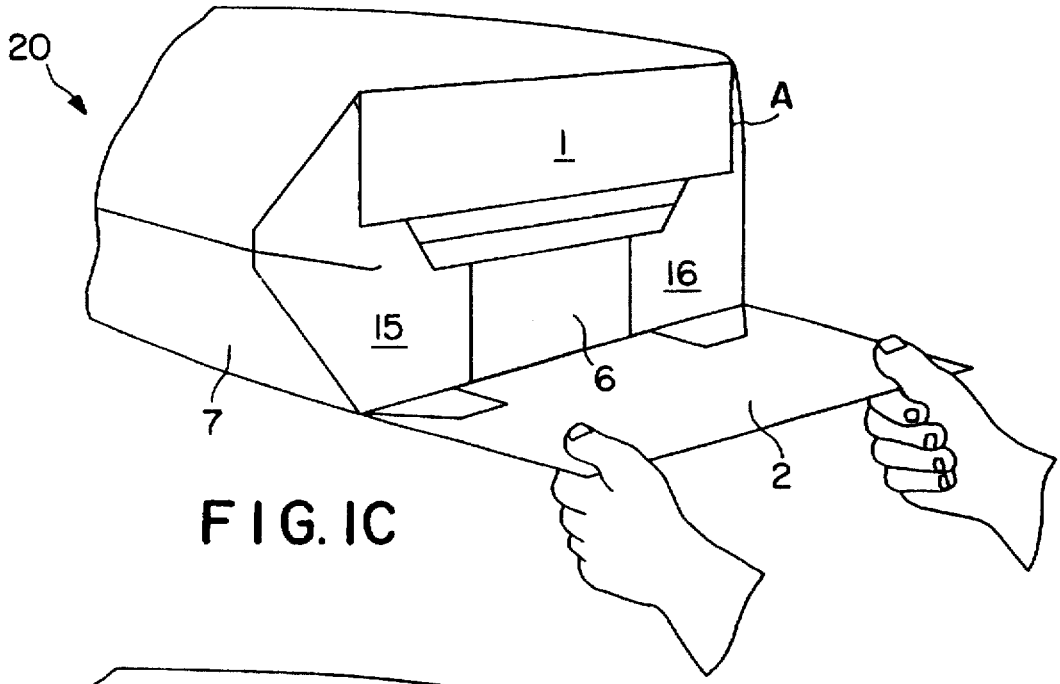
Figure 1D:
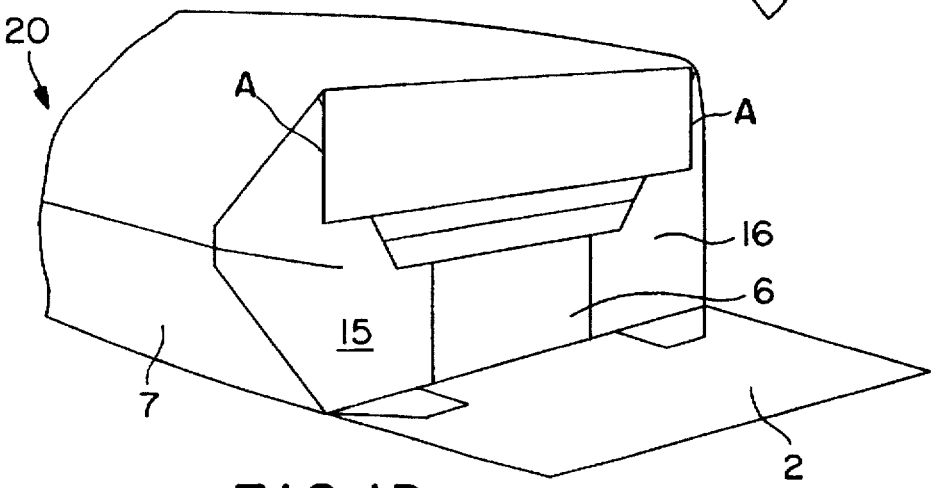

While this invention is susceptible of embodiment in many different forms, there is shown in the drawings and will be described herein in detail, several embodiments, with the understanding that the present disclosure is to be considered as an exemplification of the principles of the invention and is not intended to limit the invention to the embodiments illustrated.

The preferred container 20 as depicted in the enclosed drawings is preferably formed such as by extrusion using an adaption of existing continuous multiple ply walled manufacturing apparatus. Preferably the outer tube 7 is formed from multiple plies of paper preferably with staggered ends developed by appropriate cutting and/or perforation and any necessary separation procedures all of which are known in the art.

Figure 3A:
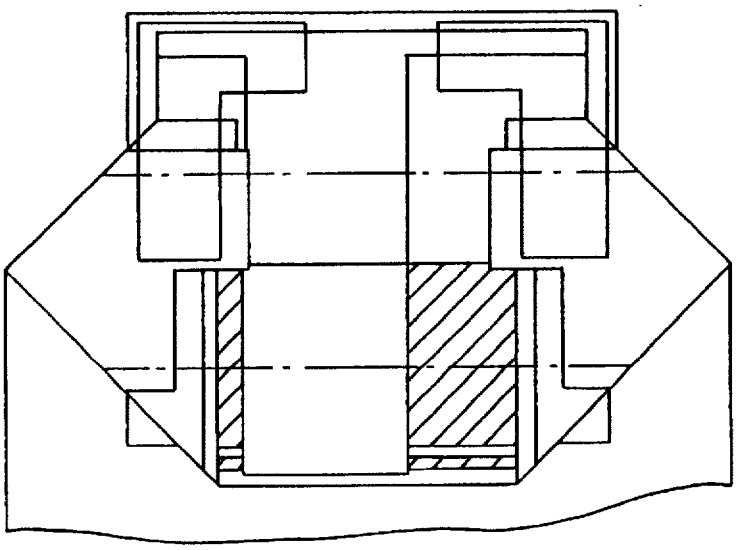
FIG. 3A PRIOR ART
FIGS. 3A to 3C are similar to those of FIGS. 2A to 2C but are in relation to a prior art arrangement whereby there is a separate flap adhesively secured to the plies of material from which the outer tube has been made.
Figure 3B:
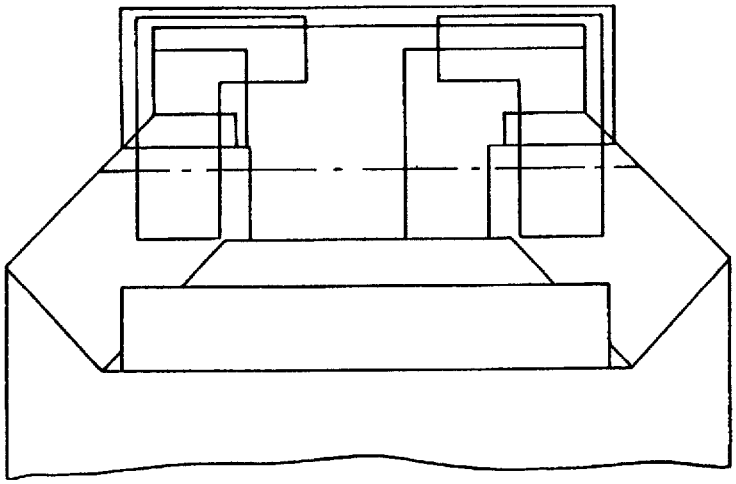
FIG. 3B PRIOR ART
Figure 3C:
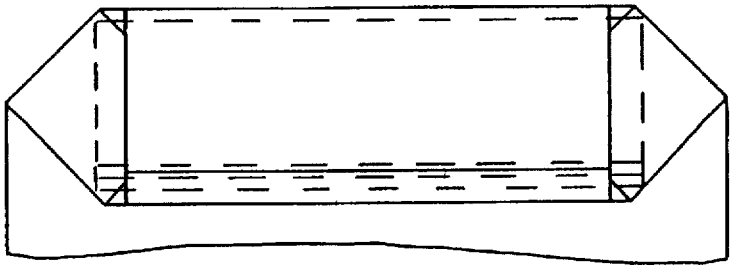
FIG. 3C PRIOR ART

The present invention differs significantly from the prior art form of multiple ply bags with a plastic liner bag which had a separate base patch provided on the outer tube as depicted in FIGS. 3A to 3C as previously supplied to the New Zealand Dairy Board, which adds complexity to manufacture and/or at least cost thereto and/or minimizes the re-use that customers of the end product may make of the resulting bag. In this respect it should be realized that in some third world countries the outer tube, once emptied, forms a valuable resource and, therefore, minimization of destruction upon opening is desirable. Moreover a reduction of the pieces that become severed from the outer tube during opening desirably should also be sought.

Bag 20, in a preferred embodiment comprises an inner tube 6, which may be a single ply tube of plastic material, and an outer tube 7, which may be a tube of paper material, which may be a single ply, or, as illustrated, is formed from several plies of material.

Preferably the opening of the outer tube 7 and the unloading of the still sealed inner tube 6 is by the sequence of steps as shown in FIGS. 1A through 1E. The filled, completely closed bag 20 is shown in FIG. 1A. In order to obtain access to the inner, plastic bag, the outermost or major outer flap 2 is grasped and peeled downwardly (FIG. 1B), thus exposing the other, minor outer flap 1, as well as portions of the inner flaps 15, 16. See FIGS. 1C and 1D. The bag is lifted by its other end, and the weight of the inner tube 6 causes the minor outer flap 1 to come free of the inner flaps 15 and 16 (if outer flap 1 has not already been peeled from inner flaps 15 and 16), thus permitting sealed inner tube 6 to fall free from the outer tube 7, leaving the outer tube 7 substantially intact.

Figure 4:
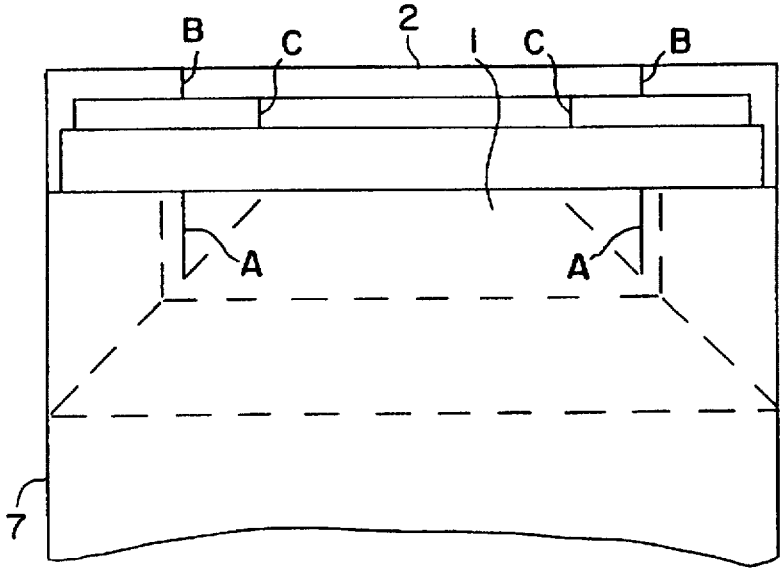
FIG. 4 is a view of the factory end of the outer tube prior to its condition as in FIG. 2A but from the side as depicted in FIG. 2A.
Figure 5:
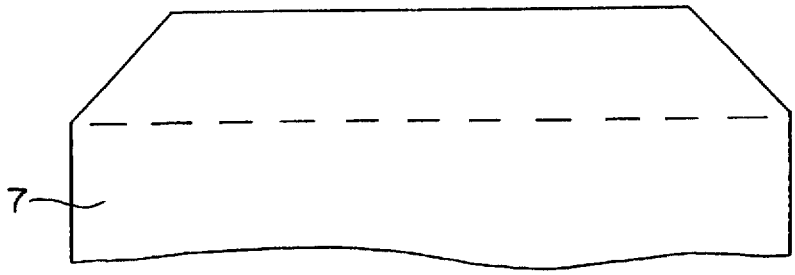
FIG. 5 is a view of the factory end as shown in FIG. 2C but from the other side.

The first or factory end of the outer tube is shown in the drawings with the lines A shown for clarity of the drawings being those cuts A also seen in FIG. 4. Likewise lines B are cuts B of FIGS. 4 and 6.

Figure 2A:
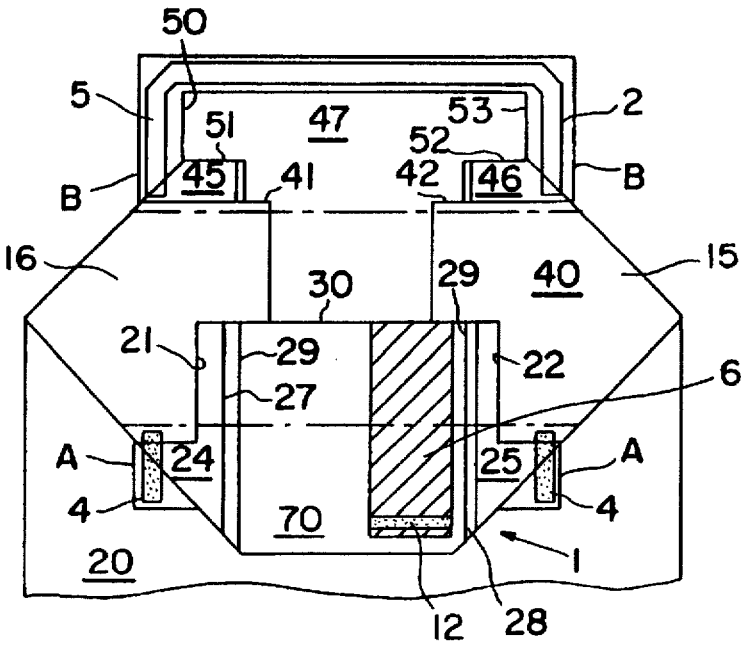
FIGS. 2A to 2C show the final folds together with adhesive regions giving rise to the base region connected by gussets to the front and rear panels of the outer tube as shown in FIG. 2C, it not mattering whether or not the base regions lies flat over what might be considered a front or back panel.
Figure 2B:
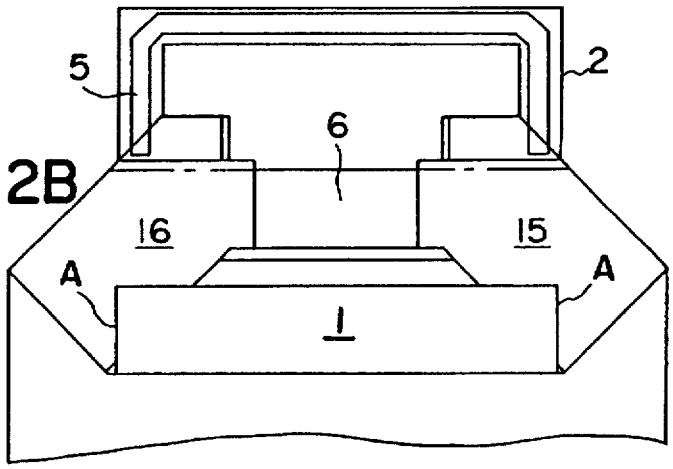
Figure 2C:
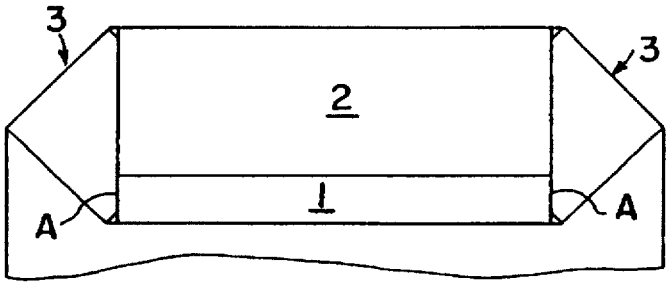

In the preferred form of the present invention, the outer tube 7 has the gusset connection base region thereof(the portion of the bag, which, when unfilled and laying flat, includes the bottom of the bag, and portions of the side gussets 3—see FIG. 2A) formed from outer flaps 1 and 2 with outer flap 2 overlying outer flap 1 (as can best be seen in FIGS. 2A through 2C) with the gusseted regions 3 of the lie flat base region over the front or back panel (as the case may be) as in FIG. 2C.

Figure 1E:
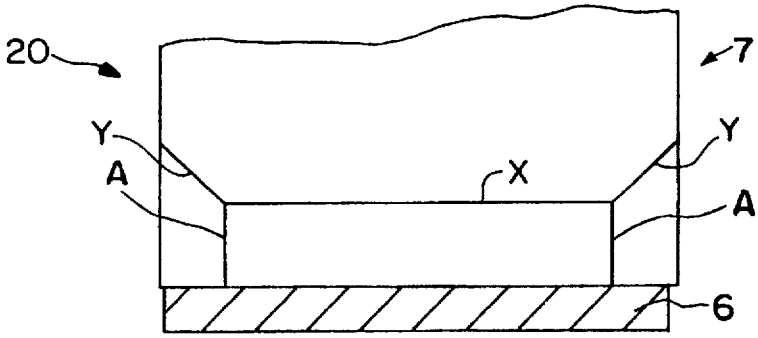

FIG. 2A shows how the flap 1 has its perimeter regions bounded by the cuts A shown in FIG. 4 provided with glue lines 4 while flap 2 includes a glue line 5. The glue lines 4 help hold flap 1 in position against the inner flaps. In a preferred embodiment of the invention, flap 1 is not peeled down and glue lines 4 are not severed (as can be seen in FIGS. 1B through 1E) until the bag 20 is lifted by its unopened end, so that the weight of the bag causes flap 1 to be released, permitting the inner tube 6 to drop out, under the force of gravity. The tearing apart as in FIGS. 1B and 1C leaves the base region in the manner substantially as illustrated in FIG. 2B, except that inner tube 6 is now filled. After opening of flap 2, and raising of the bag, the inner tube 6 will by force of gravity, fall out of outer tube 7. FIG. 1E shows inner tube 6 dropping out of the outer tube 7. Line X, represents a fold in outer tube 7, which forms the edge of the bottom of the filled bag, as seen in FIG. 2A. Lines Y represent the fold lines which form the gussets 3, as seen in FIG. 2C.

Figure 6:
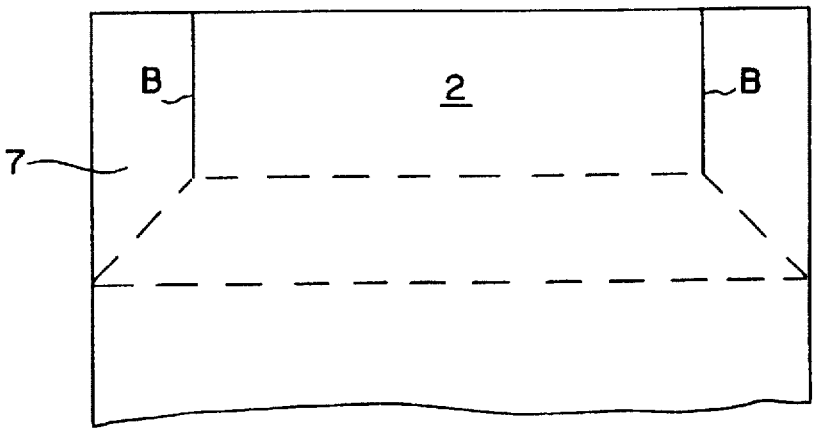
FIG. 6 is similar to FIG. 4 but showing the factory end from the other side.
Figure 7:
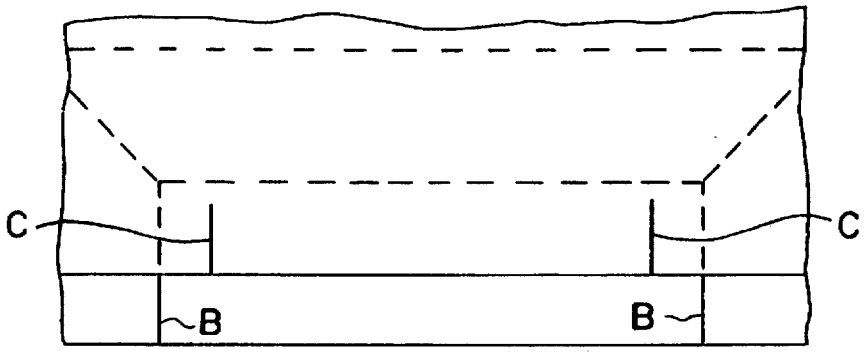
FIG. 7 is an enlarged, fragmented view, partly cut away, of the openable end of the bag, according to the embodiment of FIG., 6, as would be seen from a view point in the interior of the bag.
Figure 8:
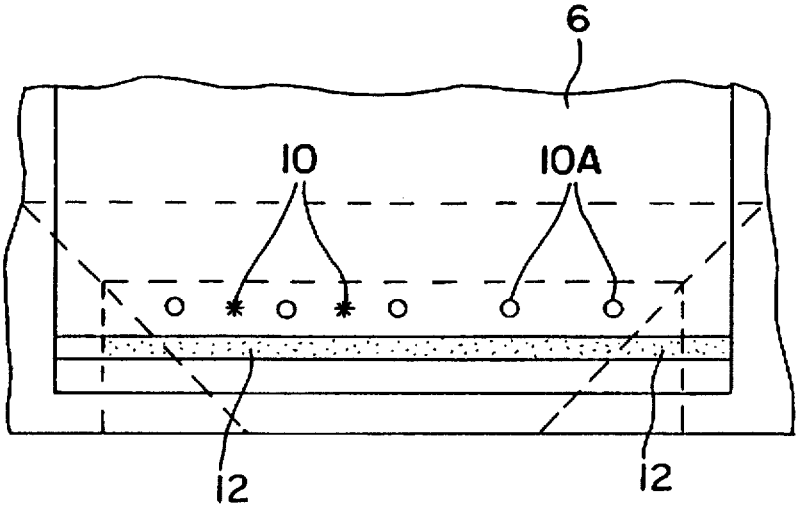
FIG. 8 is an enlarged, fragmented view, partly cut away, of the openable end of the bag, according to the embodiment of FIG. 4, as would be seen from a viewpoint in the interior of the bag.

FIG. 7 is an inverted view of the bag end illustrated in FIG. 6 (in which the bag is in a flattened, unfilled condition), as seen from the opposite direction, and from a viewpoint inside of the flattened bag. FIG. 8 is an inverted view of the bag end illustrated in FIG. 4 (in which the bag is in a flattened, unfilled condition), as seen from the opposite direction and from a viewpoint inside of the flattened bag. The innermost of the webs of one side panel of the outer tube is adapted to be adhered at points 10 on the sealed inner tube 6 (see FIG. 8), the first or factory end of the inner tube being heat sealed along the heat seal line 12. Preferably, there is an adhesive fixing of the inner tube 6 to the opposite innermost ply also but in an easily releasable manner. This adhesion is denoted by circles 10A and is under the inner tube 6 in FIG. 8.

The bag of FIGS. 1A–2C can readily be seen to have three layers to its outer tube 7. The side of the bag which corresponds to flap 1 may be considered the front, while the side of the bag which corresponds to flap 2 may be considered the back.

In the embodiment illustrated, the middle and inner layers have edges which are, in places coterminous, and only a single line representing such coterminous edges, is illustrated.

The outermost layer, on the front, is the layer corresponding to cuts A, and includes surface 23 and edges 21, 22. The middle layer is the layer corresponding to visible surfaces 24, 25. The innermost layer is the layer corresponding to visible surface 28. Edges 29 of the innermost layer, represented in FIG. 2A, in a inner flap 1, as surface 70, indicate where upon folding, edges 29 would cease to be coterminous with edges 27 of the middle layer, and would extend slightly inwardly relative to edges 27. Line 30 shows the crease in the front side representing the fold created when the bottom of the bag is caused to lie flat and generally parallel to the main tubular portion of the bag. Edge 29 is the innermost edge of the innermost layer, which has been folded over onto itself.

The outer most layer on the back side, is the layer corresponding to cuts B, and includes surface 40, and edges 41,42. The middle layer on the back is the layer corresponding to visible surfaces 45 and 46, and edges 50–53. The innermost layer on the back side corresponds to surface 47.

The particular staggering and contours of the plies of the outer tube 7 are shown only by way of example, and may be varied without departing from the scope of the invention, so long as two inner flaps, such as flaps 15, 16 (FIG. 2B) are provided, and two outer flaps 1 and 2 are provided, since the adhesive which is provided to create the peel openable bottom is applied over the surfaces as a whole, independently of the staggering and overlapping of the individual plies.

Persons skilled in the art, from the drawings, will appreciate the sequential manner in which the multiple ply outer tube 7 and the inner tube 6 are formed at its first or factory end. As a result of cuts A and B, and the flattening of the factory end, the diamond-shaped unarticulated bottom is formed, with inner flaps 15 and 16, in a manner known to those of ordinary skill in the art. Lines of adhesive 4 and 5 are placed on outer flaps I and 2, respectively. Outer flap 1 is then folded over and held by adhesive lines 4, and outer flap 2 is then folded over and held by adhesive lines 5. When minor flap 1 is folded over, the diagonally folded inner layers which produce the surfaces 24–25 and 28, as seen in FIG. 2A, extend from beneath minor flap 1, toward the center of the bottom of the bag. These extending portions can also be seen in FIG. 2B.

The manner in which first the inner tube and then the outer tube or simultaneously the inner tube and outer tube are sealed, preferably the inner tube with heat sealing, at the customer end is not relevant to an understanding of the invention but any conventional means might be used. The choice of an envelope grade adhesive capable of being peel-opened as in FIGS. 1A to 1E is preferred as an appropriate adhesive can ensure total success.

Figures 1, 2A:
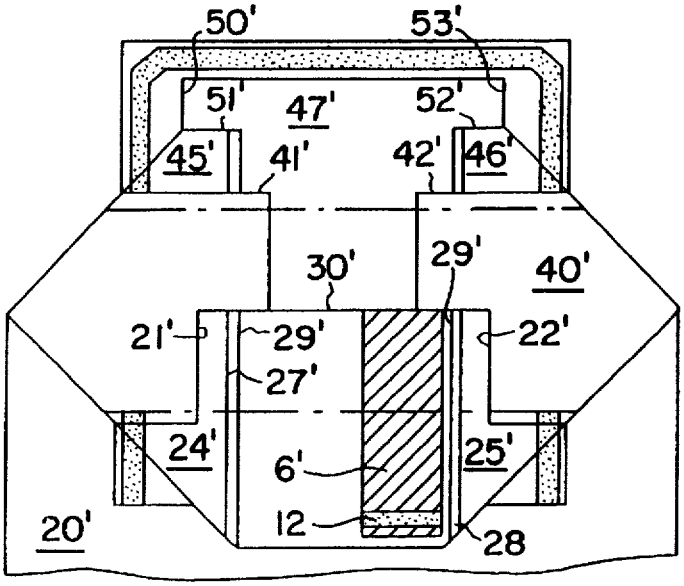
Figures 1, 2B:
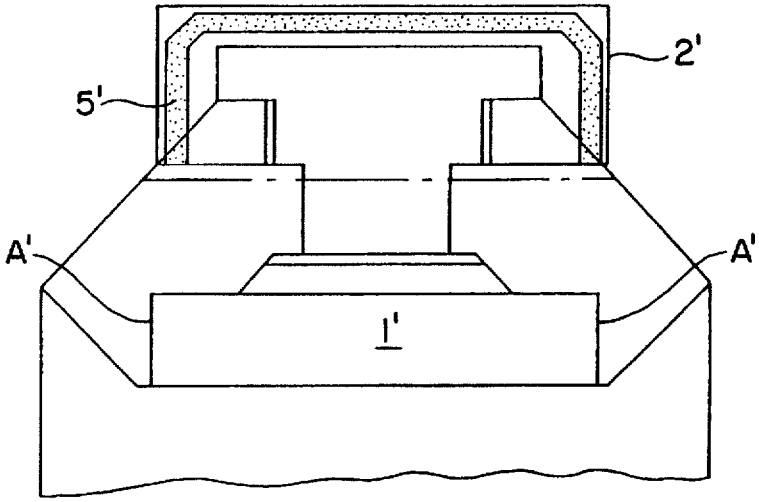
Figures 1, 2C:
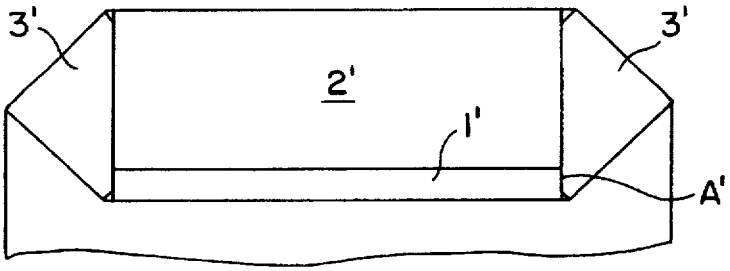

FIGS. 2A-1 through 2C-1 are very similar drawings to FIGS. 2A through 2C but showing how, in an alternative embodiment 20' with the slightly different arrangement of the staggering of the plies, a greater glued flap area can be provided to provide a stronger adhesive overlap but still within the scope of the present invention. The embodiment of FIGS. 2A-1–2C-1 , being substantially similar to that of FIGS. 1A–2C, elements having similar structures and functions have been provided with similar reference numerals, augmented by a prime (').

The adhesives capable of being utilized in the forming of a bag in accordance with the present invention include the following:

Liquid Adhesives Including: Starches, Dextrines, Polyvinyl Alcohol, Animal, Casein;

Latex Adhesive Including: Natural, Synthetic;

Emulsion Polymers Including: Polyvinyl Acetate Homopolymers, Ethylene/Vinyl Acetate Copolymers, Acrylate/Vinyl Acetate Copolymers, Polyethylene, Amorphous Polypropylene, Polyamide; and Solvent Based: Polyurethanes; Natural Polymer, Synthetic Polymers, Two Pot Systems.

The use of a container of the present invention provides some, if not all, of the advantages previously referred to.

The construction of the container of the present invention is such that when a filled container is lying substantially horizontally, the overlying flap of the base can be lifted by a person using one or two hands, the container then being movable to a condition where the base is directed downwardly and the weight of the contents in the inner tube will allow the dropping free thereof from the outer tube or the lifting free of the outer tube from the inner tube or combination of both by breaking associations and/or adhesive associations without releasing any substantial loose pieces of material from the outer tube and/or inner tube. This presumes that the second or customer ends of the inner and outer tubes have not been unreleaseably affixed to one another after filling, by the customer. Ideally, separate sealing of the inner tube at the second end, such as by heat sealing, followed by separate sealing of the outer tube at the second end, would facilitate removal of the filled inner tube in the manner described hereinabove.

Figure 9:
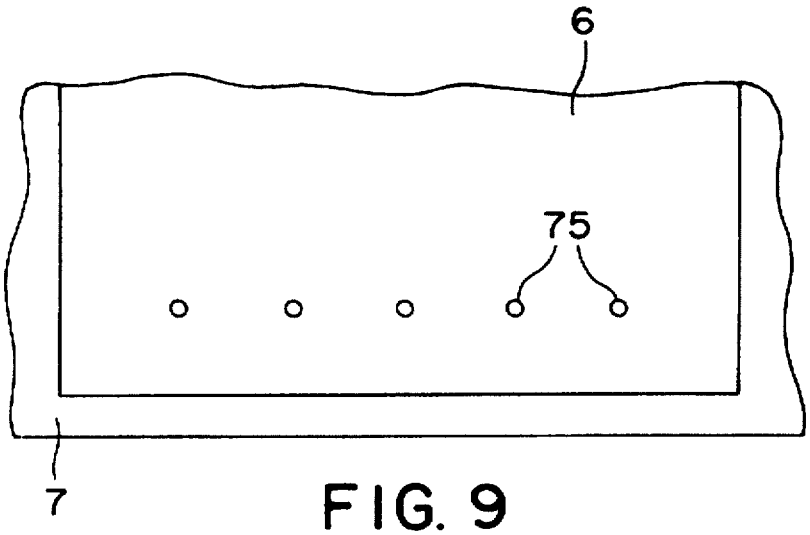
FIG. 9 is an illustration of the open, "customer " end of the bag, in section, showing how the unsealed end of the inner tube may be also be adhered to the open end of the outer tube.

FIG. 9 shows he open end, "customer" end of the bag, in section, showing how the unsealed end of the inner tube 6 may also be adhered to the open end of the outer tube 7, by means of adhesive dots 75, between the inner tube 6 and the outer tube 7.

The present invention also comprises a method of handling a liquid or granular material, or discrete items, using a container such as described.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

What is claimed is:

1. A lie flat container comprising:

an inner tube of a sealable plastics material, said inner tube having a first end, a second end, a front panel and a back panel;

an outer tube, having a first end, a second end, a front panel and a back panel;

said first end of said inner tube being disposed adjacent said first end of said outer tube;

said inner tube being disposed within said outer tube, each of said inner and outer tubes having been formed of at least one web of a planar material;

said first end of said inner tube and said first end of said outer tube being closed separately from one another, said second end of said inner tube and said second end of said outer tube being open so as to enable the filling of said inner tube prior to sealing thereof;

each of said first and second tubes being operably configured so as to lie substantially flat, when in an unfilled condition, such that said front panels and said back panels lie in substantially flat overlying relation to one another, respectively;

flap members operably formed in at least said first end of said outer tube, said flap members being operably configured to be arranged such that one flap member is in overlying relationship to the other, underlying flap member, to form a substantially planar base region operably configured so as to fold over onto one of said front and back panels of said outer tube, when said container is in an unfilled condition;

said flap members being releasably affixed to one another so as to enable separation of said flap members to enable opening of said first end of said outer tube, to further enable access to said inner tube.

2. The container according to claim 1, wherein said container is in the form of a bag.

3. The container according to claim 1, wherein said inner and outer tubes thereof are formed by extrusion.

4. The container according to claim 1, wherein said inner and outer tubes thereof are formed by fabrication.

5. The container according to claim 1, wherein said outer tube is formed from paper.

6. The container according to claim 5, wherein said outer tube is formed from multiple plies of paper.

7. The container according to claim 1, wherein said second end of said inner tube is adhered to said second end of said outer tube to facilitate filling of said inner tube.

8. The container according to claim 1, wherein at least one of the flap members is fabricated of multiple plies of material.

9. The container according to claim 1, wherein at least one ply of said underlying flap member is adhesively associated with said first end of said inner tube, said overlying flap member at said first end being formed of multiple plies and a portion of one of said multiple plies being adhered to said first end of said inner tube.

10. The container according to claim 1, further comprising means for enabling said container to assume a substantially rectangular cross-section when said inner tube is filled.

* * * * *